US005085327A

United States Patent [19]

Mercer, Jr. et al.

[11] Patent Number: 5,085,327

[45] Date of Patent: Feb. 4, 1992

[54] SPORTS EQUIPMENT ORGANIZER

[76] Inventors: Alan S. Mercer, Jr.; Alan S. Mercer, Sr., both of 11 Windsorville Rd., Broad Brook, Conn. 06016

[21] Appl. No.: 594,035

[22] Filed: Oct. 9, 1990

Related U.S. Application Data

[63] Continuation of Ser. No. 486,200, Feb. 28, 1990.

[51] Int. Cl.[5] ..... A47F 7/00

[52] U.S. Cl. ..... 211/13; 211/14

[58] Field of Search ..... 211/13, 60.1, 14, 57.1

[56] References Cited

U.S. PATENT DOCUMENTS

| | | | |
|---|---|---|---|
| 715,563 | 12/1902 | Doublat | 211/13 X |
| 1,660,479 | 2/1928 | Crowe | 211/13 |
| 3,650,407 | 3/1972 | Benham, Jr. | 211/14 |
| 3,869,137 | 3/1975 | Byrom | 211/14 X |
| 4,193,495 | 3/1980 | Keeley | 211/13 X |
| 4,227,710 | 10/1980 | Laub | 211/13 X |
| 4,253,575 | 3/1981 | Van Winkle | 211/13 |
| 4,344,660 | 8/1982 | Molnar et al. | 211/14 X |
| 4,418,930 | 12/1983 | Ryan, Jr. | 211/60.1 X |
| 4,643,317 | 2/1987 | Wilkinson | 211/14 |
| 4,807,763 | 2/1989 | Jonkowsky | 211/13 X |
| 4,854,456 | 8/1989 | Lee | 211/14 |
| 4,968,048 | 11/1990 | Lortis | 211/13 X |

OTHER PUBLICATIONS

Webster's 9th New Collegiate Dictionary.

*Primary Examiner*—Carl D. Friedman
*Assistant Examiner*—Korie H. Chan
*Attorney, Agent, or Firm*—CTC & Associates

[57] ABSTRACT

A sports equipment organizer provides a frame of rectangular elements including parallel top and bottom elements, parallel left and right vertical elements joining the top and bottom elements. The bottom element, the left element and the right element define parallel front and rear planes, and a rear element lies in the rear plane and joins and is perpendicular to the top element, the left element and the right element and has a lower edge parallel to and spaced a substantial distance above the bottom element, so that the frame is open from the front plane to the rear plane except for being closed at the rear plane by the localized presence of the rear element. The elements are provided with various configurations and devices for holding and storing sports equipment and related items.

1 Claim, 4 Drawing Sheets

SPORTS EQUIPMENT ORGANIZER

RELATED APPLICATION

This is a Continuation of our U.S. Design patent application Ser. No. 486,200 filed Feb. 28, 1990.

BACKGROUND OF THE INVENTION

This invention relates to a sports equipment organizer and is an item of furniture of attractive appearance and which provides a way for a person, particularly a youngster, to keep sports equipment in a neat and orderly fashion when not in use.

Still more particularly, the inventive sports equipment organizer provides an economical, attractive and usable storage facility that is substantially as easy for a youngster to use as it is for the youngster to throw the sports equipment on a bed or a floor. In other words, the inventive sports equipment organizer promotes neatness and eliminates the usual and normal panic calls of youngsters when he or she cannot find his or her sports equipment.

The above and other objects and advantages of the invention will appear more clearly hereinafter.

SUMMARY OF THE INVENTION

A sports equipment organizer according to the present invention is made up of a frame of suitably connected generally rectangular elements, including parallel top and bottom elements and parallel left and right elements perpendicular to and joining the top and bottom elements. The bottom, left and right elements define parallel vertical front and rear planes and the frame also includes a rectangular rear element lying in the rear plane and joining and perpendicular to the top, left and right elements and having a lower edge parallel to but spaced a substantial distance above the bottom element.

The organizer is thus open from the front plane to the rear plane except for being closed at the rear plane by the localized presence of the rear element adjacent the top element.

The top element has a plurality of circular holes therethrough that may be of different diameters for holding balls such as basketballs, soccer balls, footballs, volleyballs and the like. The top element may also have a plurality of semi-round holes therethrough with openings at the front edge of the top element for holding bats vertically within the organizer.

A plurality of spaced members project toward the front plane from the rear element. The spaced members may be used to hang articles of clothing, baseball gloves, boxing gloves, jackets and the like.

The left element may have one or a plurality of horizontal pegs projecting internally and externally therefrom and the right element may have upwardly tilted pegs projecting internally therefrom toward the left element and which may be used to hang such elements as baseball gloves or mitts. The right element may also have an upwardly tilted peg projecting externally therefrom away from the left element.

The bottom element provides a floor that may be used to hold a box for storage of other items.

The ends of the top element may project symmetrically somewhat beyond the left and right elements. Also, the top element has a front edge that may project somewhat forward of the front plane.

The organizer further has a base beneath the bottom element to hold the same somewhat elevated.

Suitable material for all components of the organizer are wood, plastic, laminated composition board and combinations thereof.

DESCRIPTION OF THE INVENTION

Figure 1:
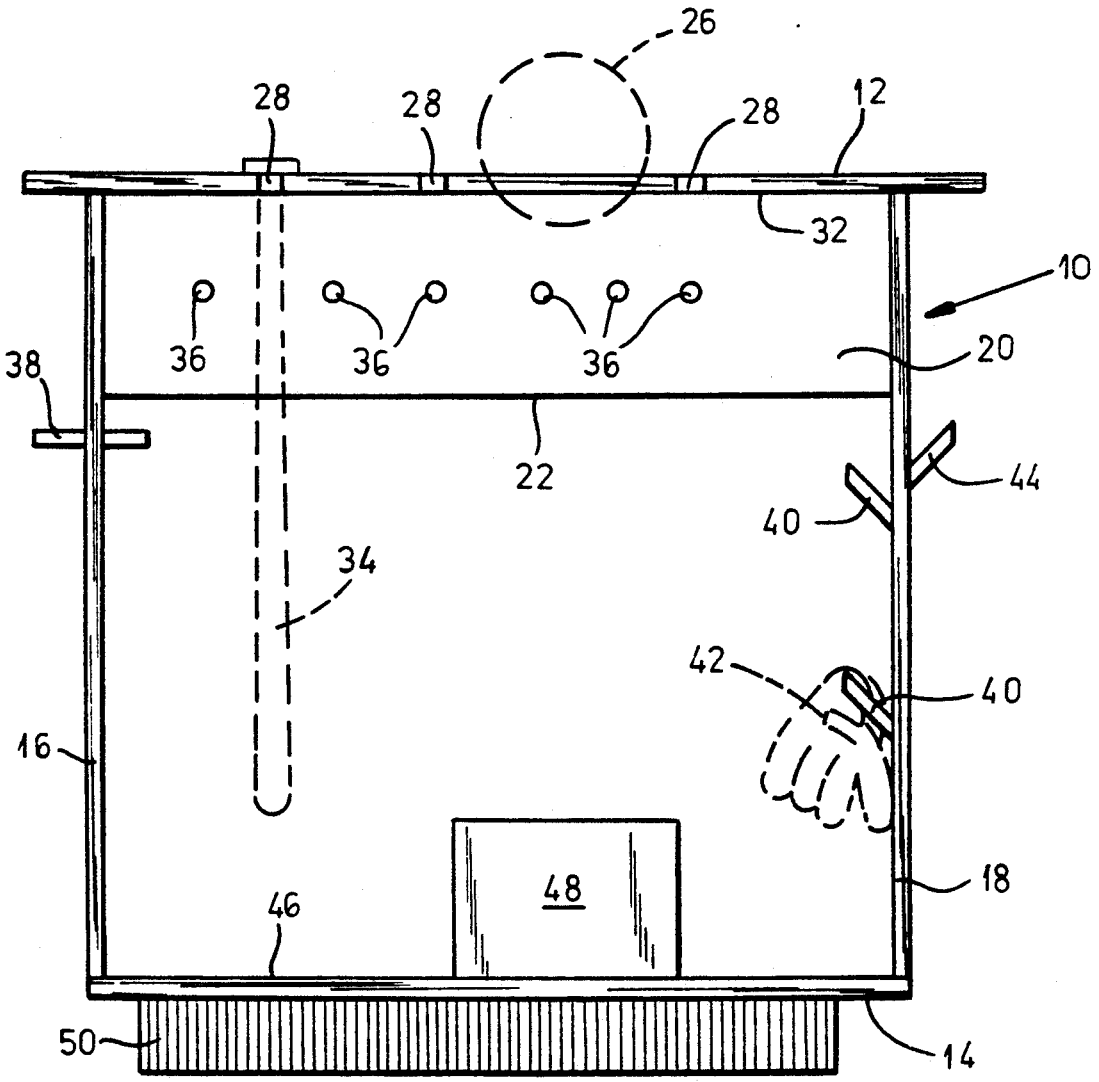
FIG. 1 is a front elevation of a sports equipment organizer embodying the invention.

The drawing illustrates a sports equipment organizer 10 that is a preferred embodiment of the invention. Organizer 10 comprises a frame of suitably connected generally rectangular elements of suitable material such as wood, plastic, laminated composition board and combinations thereof including parallel top and bottom elements 12 and 14, respectively, and parallel left and right elements 16 and 18, respectively, joining top and bottom elements 12 and 14. Elements 14, 16 and 18 define parallel vertical front and rear planes. The frame also includes a rectangular rear element 20 (best seen in FIGS. 1 and 2) lying in the rear plane and joining and perpendicular to top element 12, left element 16 and right element 18 and having a lower edge 22 parallel to and spaced a substantial distance above bottom element 14.

The frame of organizer 10 is open from the front plane to the rear plane except for being closed at the rear plane by the localized presence of rear element 20 adjacent top element 12.

Figure 5:
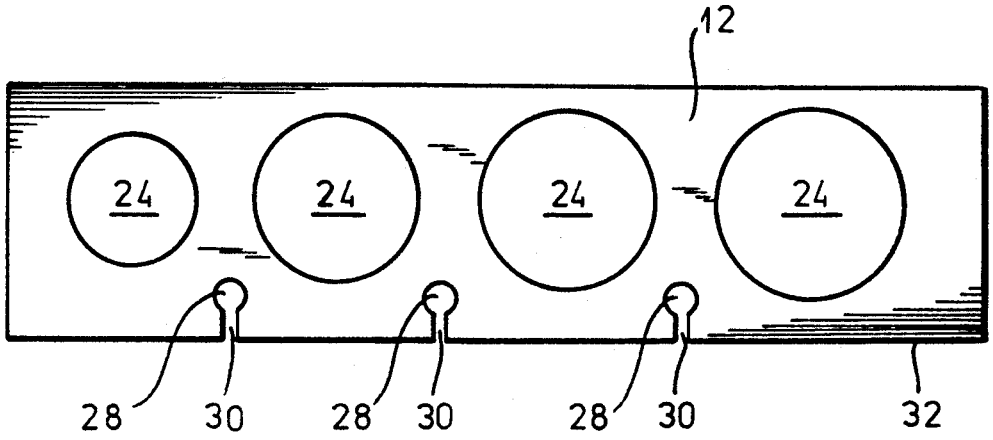
FIG. 5 is a top plan view of the organizer of FIG. 1.

Top element 12 has a plurality of circular holes 24 therethrough. As seen in FIG. 5, holes 24 are not all of the same diameter, left-most hole 24 being of smaller diameter than the other three holes 24. Holes 24 may be used to hold balls, one of which is shown at 26 in phantom in FIG. 1. The so held balls 26 may for example be balls of different diameters, such as basketballs, soccer balls, footballs, volleyballs and the like.

Top element 12 is also shown as having a plurality of semi-round holes 28 therethrough with openings 30 at front edge 32 of top element 12, so that holes 28 are adapted for holding bats, golf clubs, lacrosse rackets and the like vertically within the frame of organizer 10. One such bat is indicated in phantom at 34 in FIG. 1.

A plurality of horizontal spaced members 36 project horizontally from rear element 20 toward the front plane. Members 36 can be used to hang articles of clothing, such as jackets.

Figure 2:
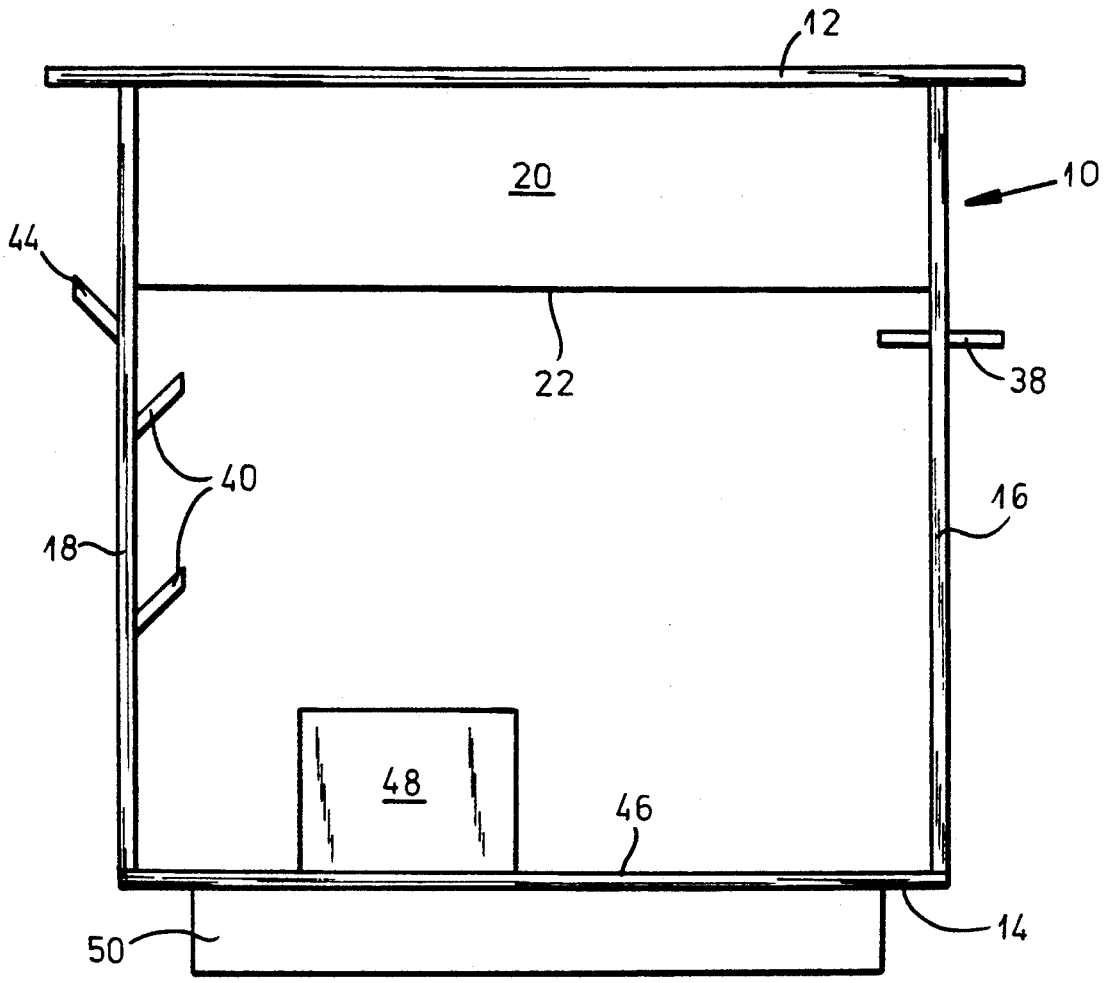
FIG. 2 is a rear elevation of the organizer of FIG. 1.
Figure 3:
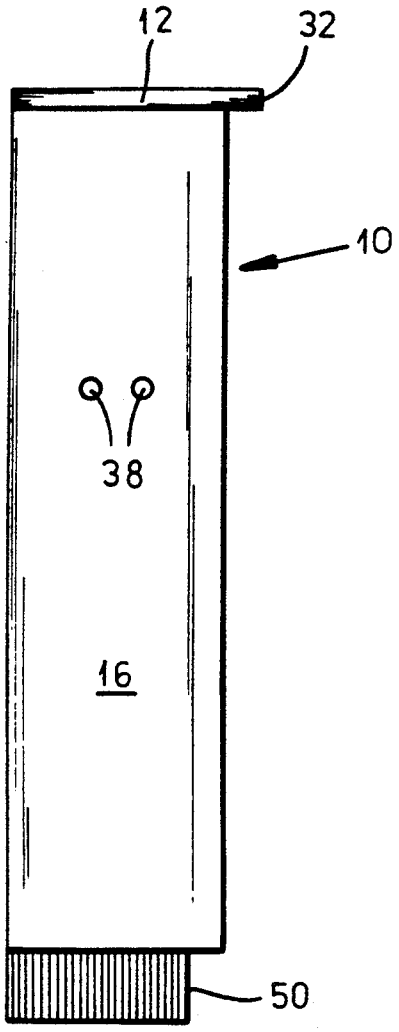
FIG. 3 is a left side elevation of the organizer of FIG. 1.
Figure 4:
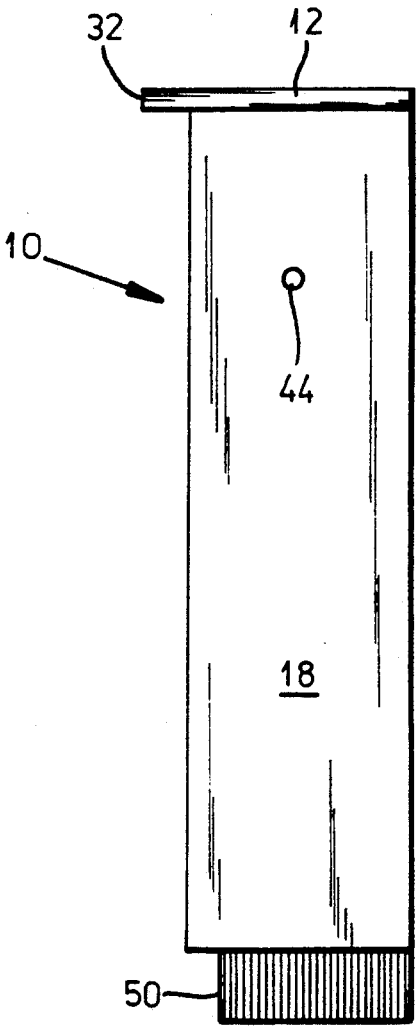
FIG. 4 is a right side elevation of the organizer of FIG. 1.

Left element 16 is shown with a pair of horizontal pegs 38 projecting therethrough, and right element 18 is shown as having upwardly tilted pegs 40 projecting internally therefrom toward left element 16, for use, for example, in hanging baseball gloves or mitts, such a glove being shown in phantom at 42 in FIG. 1. Right element 18 also has an upwardly tilted peg 44 projecting externally therefrom away from left element 16.

Bottom element 14 provides a floor 46 that may be used to hold an additional item such as a box 48 for storage of other items.

Top element 12 is shown as having ends that project symmetrically somewhat beyond left element 16 and right element 18. Also, top element 12 is shown as projecting somewhat forwardly from the front plane.

Organizer 10 further has a base 50 beneath bottom element 14 to hold the latter somewhat elevated.

It is apparent that the invention well attains the stated objects and advantages as well as others.

The disclosed details are exemplary only and are not to be taken as limitations on the invention except as those details may be included in the appended claims.

What is claimed is:

1. A sports equipment organizer comprising an open front frame with a top element joined in perpendicular relationship to two vertical parallel side members and a back member, said back member joined in perpendicular relationship to said side members and adjacent to the top member, said side members extending to an joining a bottom member in perpendicular relationship; said top member has a plurality of different diameter holes therethrough for holding sports balls of different diameters and a plurality of semiround holes along a front edge thereof for holding bats vertically; said back member has a plurality of spaced members projecting toward said open front frame to hang articles of clothing therefrom within said open front frame sports organizer; said side members having a plurality of horizontal and upwardly tilted pegs projecting both inside and outside of said open front frame from which to hang sports equipment and articles of clothing; said bottom member being supported by a base beneath a bottom thereof to hold said bottom member somewhat elevated, said bottom member having a top side for supporting sports shoes and an open top box for storage of balls; said joined top element, side members, back member, bottom member and base acting in concert to form said sports equipment organizer.

* * * * *